United States Patent [19]

Koziol et al.

[11] Patent Number: 4,661,232

[45] Date of Patent: Apr. 28, 1987

[54] ELECTRODE FOR ELECTROLYTIC EXTRACTION OF METALS OR METAL OXIDES

[75] Inventors: Konrad Koziol, Röthenbach a.d. Pegnitz; Erich Wenk, Nuremberg, both of Fed. Rep. of Germany

[73] Assignee: Conradty GmbH & Co. Metallelektroden KG, Fed. Rep. of Germany

[21] Appl. No.: 703,549

[22] Filed: Feb. 20, 1985

[30] Foreign Application Priority Data

Feb. 24, 1984 [DE] Fed. Rep. of Germany ..... 3406797

[51] Int. Cl.[4] ..... C25C 7/02; C25B 11/00

[52] U.S. Cl. ..... 204/286; 204/289

[58] Field of Search ..... 204/286–289, 204/284, 279, 280

[56] References Cited

U.S. PATENT DOCUMENTS

| | | | |
|---|---|---|---|
| 3,671,415 | 6/1972 | King et al. | 204/286 X |
| 3,746,631 | 7/1973 | Glos et al. | 204/284 X |
| 3,839,179 | 10/1974 | Koziol et al. | 204/284 X |
| 3,907,659 | 9/1975 | Paige et al. | 204/286 X |
| 4,319,977 | 3/1982 | Wortley | 204/286 X |
| 4,364,811 | 12/1982 | Fabian et al. | 204/288 X |

*Primary Examiner*—Donald R. Valentine

*Attorney, Agent, or Firm*—Lyon & Lyon

[57] ABSTRACT

An electrode comprises a horizontally arranged current feed which is formed by a rail of copper or has such a rail as a current conductive component. From this rail at least one current distributor branches, which is constructed of a sleeve of valve metal and a core arranged therein, and of a metal which is a good electrical conductor which is in electrical connection with the sleeve and in which preferably a contact structure is embedded which consists of valve metal and is connected to the inner surface of the sleeve by a plurality of weld positions. To the sleeve of the current distributor an active part of the electrode is mechanically and electrically conductively connected.

The essential feature of this electrode consists in that in the core of the current distributor a bar of material which is a good electrical conductor, preferably copper, engages which is connected in a mechanically and electrically conductive manner to the rail of the current feed.

8 Claims, 6 Drawing Figures

ELECTRODE FOR ELECTROLYTIC EXTRACTION OF METALS OR METAL OXIDES

The invention relates to an electrode, in particular an anode of coated valve metal for electrolytic extraction of metals or metal oxides, comprising a horizontally arranged current feed provided with a sleeve, at least one current distributor branching from this current feed which is constructed from a sleeve of valve metal and a core arranged therein of metal which is a good electrical conductor and which is in electrical connection with the sleeve and in which preferably a contact structure is embedded which consists of valve metal and is connected via a plurality of weld positions to the inner surface of the sleeve, and an active part which is mechanically and electrically connected to the sleeve of the current distributor.

Coated metal anodes of this type are intended to replace the anodes of lead, lead alloys or graphite formerly used in the field of electrolytic extraction of metals, in particular non-ferrous metals, from acid solutions which contain the metal to be extracted. The working surface or the active part of these coated metal anodes consists of a core carrier of valve metal such as for example titanium, zirconium, niobium or tantalum, on which is applied a coating of an anodically effective material, for example of metals from the platinum group or the platinum metal oxides.

The main advantage of the metal anodes consists in the saving of electrical energy as compared with the usual lead or graphite anodes. This energy economy results from the larger outer surface which can be achieved with coated metal anodes, the high activity of the coating and the shape stability. It enables a considerable reduction of the anode voltage. The coated metal anodes result in a further operational economy in that cleaning and neutralization of the electrolyte is simplified since the anode coating is not destroyed by $Cl^-$, $NO_3^-$ or free $H_2SO_4$. An additional cost saving is achieved in that, with the use of coated metal anodes, the electrolyte need not be alloyed with expensive components such as cobalt compounds or strontium carbonate, such as is necessary in the use of lead anodes.

Furthermore, contamination of the electrolyte and the extracted metal with lead, which cannot be avoided with lead anodes, is prevented. Finally, the coated metal anodes permit increase of the current density and thus of the productivity.

In the development of these coated metal anodes, widely differing routes have been followed.

In a known metal anode of the type under discussion (DE-OS No. 24 04 167) the important construction criterion was seen in that the anode surface lying opposite the cathode should be 1.5 to 20 times smaller than the cathode outer surface and the anode would accordingly be operated with a current density which is 1.5 to 20 times larger than the cathode current density. As a result, in an economical manner a relatively clean metal extraction of the desired crystalline structure and purity is alleged to be obtained on the cathodes. It is apparently maintained that the economy consists in that as a result of the reduced surface of the anode opposite the cathode the material consumption for the production of the anode is reduced and thus expensive valve metal substance is saved. The cost reduction in the manufacture of this anode is however achieved at the expense of not inconsiderable disadvantages. One of the disadvantages consists in that the anodic component of the cell voltage is high because the anode operates with a high current density. This necessarily results in the substantial disadvantage of high energy requirements for the cells equipped with such anodes. The large current density and the reduced conductive cross-section of the known anode, as a result of the reduced effective surface and thus of the smaller material volume, necessarily results in a larger internal ohmic voltage drop with the consequence of further increase of the necessary electrical energy. In order to eliminate the disadvantage of the large internal ohmic voltage drop, the profile bars arranged in one plane parallel to one another, which form the effective surfaces, consist of a sleeve of titanium which is provided with a copper core. The current feed and distribution rails have a comparable construction. These are guided in a complicated manner in order to shorten substantially the current path in the small effective surface of the anode. The complicated construction of the profile bars forming the effective surface and the necessarily long current feed and distribution rails increase the expense of the known construction considerably.

In a further known coated metal anode (DE-OS No. 30 05 795) a completely different route has been taken for preventing the principal disadvantages of the above described coated metal anode, which consists in that the effective surface of this anode is constructed to be very large in such manner that the mutually spaced and parallel bars arranged in one plane to form the effective surface satisfy the relationship $6 \geqq F_A/F_P \geqq 2$, $F_A$ signifying the total outer surface of the bars and $F_P$ signifying the surface assumed by the overall arrangement of the bars. This anode construction, preferably manufactured from pure titanium, has no current feed and distributor besides the main current feed bar of copper. The current transport in the vertical direction is undertaken solely by the bars of valve metal. All in all, this anode has proved very effective in many electrolytic metal extraction methods owing to the large construction of the effective surface.

In order to adapt the titanium anodes to increasing kilowatt hour prices, i.e. to reduced internal ohmic voltage drop, the introduction of larger conductive cross-sections for the current-carrying components of this expensive metal is required. When constructing the active surface of two titanium bars arranged parallel to one another in one plane, these must be constructed with appropriately large cross-section in order to keep pace with the internal ohmic voltage drop occurring in thick massive lead anodes, which reduces again the technical and economic advantages of the valve metal anodes.

With the known current feed and distribution rails, consisting of a core of copper and a sleeve of titanium surrounding this copper core, it is attempted to achieve a "metallurgical joint" between the metal of the core and the metal of the sleeve. The reduction of the internal voltage drop, which is supposed to be achieved by constructing the core of a metal having good electrical conductivity, is only however actually achieved if the current transfer to the coated active part is ensured by a large area fault-free metallurgical joint between the material of the sleeve and the material of the core. This requirement is however achieved to a limited extent only with a very expensive manufacture. In spite of this, these current feeds for anodes have proved effective in chlor-alkali-electrolysis according to the diaphragm process. The temperature sensitivity of the metallurgical joint between copper and titanium presupposed that in the case of recoating of these DIA anodes the titanium clad copper bar is separated from the active part which is to be coated.

The electrode set forth in the preamble of claim 1 was developed to solve these problems (DE-OS No. 32 09 138). According to this, attention was first of all directed to the construction of the current feed and of the current distributor. The main constructional idea in this electrode consists in that the current feed and the current distributor are constructed from a valve metal sleeve assembled from profile members and having a core therein of metal which is a good electrical conductor, the core being in good electrical connection with the sleeve and moreover a contact structure being embedded in this core which consists of valve metal and is connected via a plurality of weld points to the inner surface of the sleeve. Such a contact structure is three-dimensional and has a plurality of surfaces oriented in a plurality of directions and is surrounded by the core metal from a plurality of directions. According to a preferred embodiment, the contact structure consists of one or more strips of expanded metal, wire netting, apertured sheet or the like. Each strip advantageously lies in the current feed or current distributor in the direction of current flow. By means of the described features, in the known electrode a good electrical connection between the core metal and the sleeve metal is achieved with the consequence of small voltage drops even with high current loads. The internal contact achieved between the contact structure and the core metal remains effective for a long service life even when subjected to high temperature differences. Moreover, the contact structure improves the mechanical strength of the correspondingly constructed current feeding component and thus of the electrode as a whole. The described electrode can moreover be manufactured cheaply and economically because the difficulties which occur in the previously known arrangements in respect of the metallurgical joint between the core metal and the sleeve metal or in respect of the provision of a suitable intermediate layer, for example of a substance which is liquid at the operational temperatures, are avoided. In the manufacture of the known electrode, the core metal can be simply poured into the inner space of the sleeve in the fluid state. As a result of the corresponding formation of the contact structure, the core metal flows around inside the contact structure and forms a shrink fit on this with the creation of residual stresses. As a result, the desired good contact between the core metal and the contact structure is achieved. This is in addition welded in an electrically conductive manner to the inner surface of the sleeve. Thus, everything considered, the known electrode is distinguished by a very small internal voltage drop over a long service life, by cost-favourable and economic manufacture possibilities, by high operational safety and by its relatively flat construction.

The invention is concerned now with the problem of constructively further developing the electrode according to DE-OS No 32 09 138 and thus optimizing it for practical application.

Related to this problem, it is an object of the invention to provide for this electrode a connection construction between the current feed and the current distributor or distributors which feeds the current to the active part of the electrode, which requires an electrical voltage drop which is as small as possible, can be manufactured economically and moreover is mechanically sturdy in order to satisfy the operational realities of these metal electrodes with their use in the electrolytic extraction of metals or metal oxides. The electrodes must as is known be removed from the cell for cleaning or stripping and thereafter be reinserted into these, in this operation and moving process considerable mechanical effects being exertable on the electrodes.

This object is solved with an electrode of the abovedescribed type in that in the interior of the sleeve of the current feed a rail of copper is arranged and in that in the core of the current distributor likewise a bar of material which is a good electrical conductor, preferably copper, engages which is mechanically and electrically conductively connected to the rail of the current feed, the components of electrically conductive material, that is to say the rails of the current feed and the bar or the bars of the current distributor or distributors, being completely sheathed.

The electrode according to the invention is distinguished by a construction which is as simple as possible, in particular having regard to the connection construction between the current feed and the current distributor or distributors. On the copper rails of the current feed, a copper bar is connected for each current distributor. This copper bar provides not only the electrical connection between the current feed and the respective current distributor, but also represents the mechanical carrying connection of the current distributor on the current feed. This connection ensures in addition a current transfer which is as good as possible as a result of the material pairing copper/copper. This applies in particular if a metallurgical joint between the copper rail and the bar is achieved, for example by argon arc welding, pressure welding or explosion welding. It has proved in many expermiments that by using a purely mechanical connection such as for example screws, clamps or the like a sufficiently good current transfer between the components cannot be achieved. Moreover, of course also the mechanical connection means are unfavourable having regard to costs and usually are also insufficiently mechanically rigid since there is a real possibility of their loosening as a result of force effects.

The connection of copper rail to copper bar enables furthermore an arbitrary construction of the current feed and current distributor having regard to form and dimensions, whilst retaining the same form and same dimensions of the copper rail and copper bar for the current feed, since the other components can be simply built around this core group in an arbitrary manner corresponding to the requirements of the electrode. Sheathed current feed and sheathed current distributor form moreover a type of autonomous construction onto which the active parts can be mounted in an easily exchangeable manner.

A particularly favourable current transfer from the current feed to the respective current distributor is achieved in that according to a further development of the solution according to the invention the bar passes through the core of the current distributor substantially over its entire length. By this measure, also a uniform current distribution to the active part of the electrode is achieved.

Finally, the electrode according to the invention is very mechanically sturdy. This is important because the electrode, as is knowm, must be removed from the cell for cleaning or stripping and thereafter reinserted into the cell again, considerable mechanical stress being exerted on the electrodes during these operations and movements.

A particularly favourable current transfer between the bar of the current distributor and the core of the same and thus with reference to the active part is achieved in a further construction of the invention in that the bar has an outer surface structure such that a form-locking toothed region between the bar and the core results. This outer surface structure can be formed by grooves, holes, projections or the like.

For the prevention of corrosion of the current supplying components of the electrode according to the invention, it has furthermore proved to be expedient that the rail of the current feed is sheathed by a sleeve and the sleeve of the current distributor is connected to the current feed sleeve in a gas and liquid tight manner.

For this purpose, there are basically several methods available. One consists in that the current feed sleeve is produced by sheating the rail in corrosion-resistant material, e.g. lead. A second possibility consists in that the current feed sleeve is formed from combined profile members of valve metal.

In the case in which the current feed sleeve is formed by assembled profile members of valve metal, it is of advantage that the current feed sleeve and the current distributor sleeve are both filled with core metal. By this measure there results a very uniformly constructed electrode having small voltage drop and large mechanical sturdiness.

In this solution it is recommendable finally that in the core of the current feed a contact structure is embedded. By this measure, the advantages are also achieved for the current feed which have already been explained in connection with the correspondingly constructed current distributor.

The expedient materials for the active part of the electrode according to the invention have already been mentioned. It consists accordingly of a supporting core of a valve metal, such as for example titanium, zirconium, niobium, or tantalum on which a coating of an anodically effective material, for example of metals of the platinum group or of platinum metal oxides, is applied. The form of the active part can be selected arbitrarily. It can be formed of rods, sheets or the like. It is particularly preferred however to use corrugated expanded metal because this configuration results in a very large active outer surface economical in the consumption of valve metal and in addition is sufficiently mechanically stable, in particular if protective measures are undertaken for the free edges of the selected expanded profile member. Such protective measures can consist in separately applied material strips on the free edges of the active part of expanded metal.

The profile members for the sleeves of the electrode according to the invention, both with reference to the current distributor and also with reference to the corresponding construction of the current feed, have expediently a wall thickness between 0.5 mm and a few millimeters. They consist likewise of one of the alreadymentioned valve metals.

As metal for the manufacture of the core of the current distributor used in the electrode according to the invention, metals having a melting point which lies at least 500° C. lower than the metal of the sleeve of the current feeding components are suitable. The core metal should furthermore have a substantially higher electrical conductivity than the valve metal of the sleeve, for example titanium. Having regard to these requirements, the core metal may be manufacture from zinc, aluminium, magnesium, tin, antimony, lead, calcium, copper or silver, and corresponding alloys. Of course, selection of the metal for the core must take account of the special requirements of the respective metal extraction process. For the electrolytic extraction of zinc, zinc may be employed as core metal. The same applies for the extraction of copper, although here also aluminium, magnesium, or lead and corresponding alloys may be employed.

The solution according to the invention is suitable for the construction both of smaller electrode types with electrode surfaces of about 1.0 to about 1.2 $m^2$ and also for so-called jumbo electrodes having an electrode area of about 2.6 $m^2$ to about 3.2 $m^2$.

The construction and advantages of exemplary embodiments of the electrodes according to the invention will be explained in the following with reference to the drawings, in which.

Figure 1:
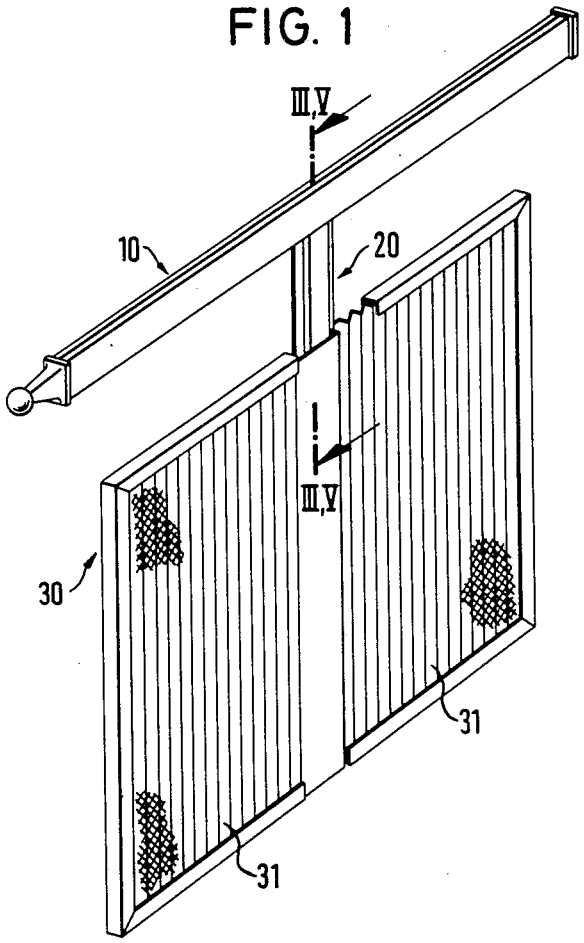
FIG. 1 is a perspective overall view of a small electrode constructed according to the invention.
Figure 2:
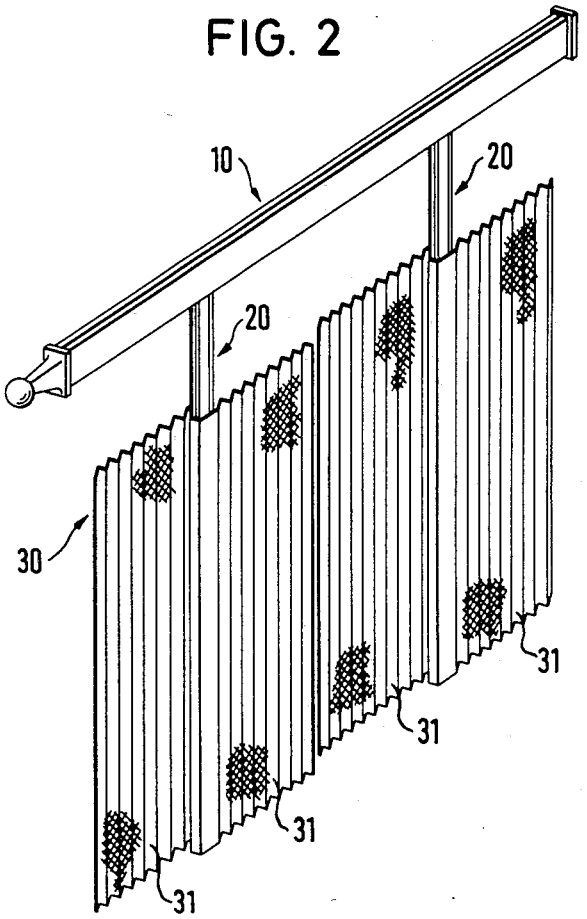
FIG. 2 shows a perspective overall view of a large electrode constructed according to the invention.

FIGS. 1 and 2 show the principal construction of two versions of a coated metal anode according to the invention. Accordingly, a current feed designated with 10, a current distributor with 20, and an active part connected to the current distributor, i.e. the active effective surface of the electrode, is designated with 30.

FIG. 1 shows the small and most usual version of a metal anode having an anode surface of about b 1.0 to 1.2 $m^2$. In this small electrode only one current distributor 20 connected to the current feed 10 is provided on whose two sides parallel to the current feed respective plate-like elements 31 are arranged which together form the active part 30.

In FIG. 2 in contrast is illustrated a so-called jumbo anode having an anode surface of about 2.6 to 3.2 $m^2$. This electrode comprises two current distributors 20 connected to the current feed 10. On each of these current distributors 20 are arranged on respective sides plate-like elements 31, so that overall four of these plate-like elements 31 form the active part 30 of the electrode. The lateral edges of the two inner plate-like elements 31 can lie at a distance from one another and can be connected together by not illustrated bridging elements. The two inner plate-like elements 31 can however also be formed by one integral element.

Figure 3:
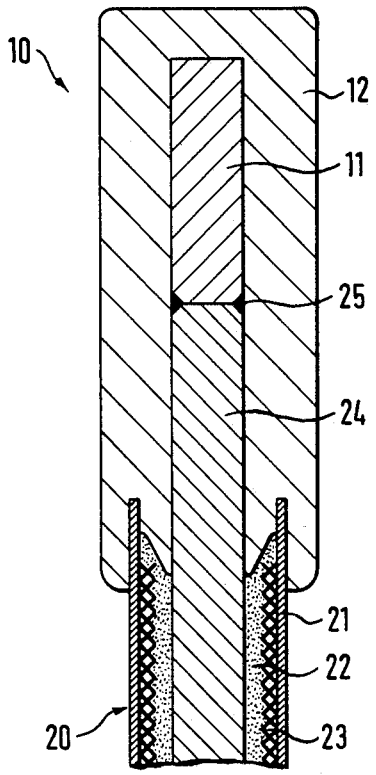
FIG. 3 shows a first embodiment of connection construction between the current feed and the current distributor in a view corresponding to the section line III—III in FIG. 1.

FIG. 3 shows a first exemplary embodiment of the solution according to the invention. Accordingly, the current feed 10, as has already been explained, comprises a horizontally extending rail 11 preferably of copper. The current distributor designated as a whole with 20 has a sleeve 21 which expediently is assembled from profile members of valve metal. With reference to the construction of this sleeve reference may be made for example of DE-OS No. 32 09 138. In this sleeve a core 22 of material which is a good electrical conductor is poured in. In this core 22 a contact structure 23 is embedded which is connected via a plurality of weld positions to the inner surface of the sleeve 21.

It is of particular significance that in the core 22 of the current distributor 20 not only the contact structure 23 is embedded but moreover also a bar 24, which preferably extends substantially the entire length of the current distributor 20. This bar 24 can have any arbitrary cross-section. It is however preferred to employ a rectangular cross-section having a width which corresponds to the width of the rail 11 of the current feed 10. By this means a particularly flat constructed electrode results.

The bar 24 of the current distributor 20 represents the component which serves both for the mechanical connection of the current distributor 20 to the current feed 10 and also serves for the current transfer between these two components. For this purpose, the upper end of the bar 24 is welded to the lower surface of the rail 11 by a weld seam 25. By this means there results a metallurgical joint between rail 11 and bar 24 which ensures an extremely good current transfer as well as a mechanically rigid and stress-resistant joint. The bar 24 preferably consists of copper as does the rail 11.

According to FIG. 3, the rail 11 of the current feed 10 is sheathed by a sleeve 12 which expediently consists of lead. The sleeve 12 covers the upper edge of the sleeve 21 of the current distributor 20, whereby a connection which is both gas and liquid tight results.

Figure 4:
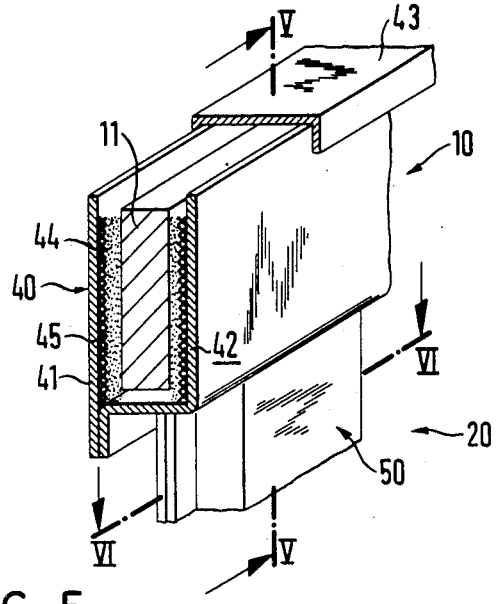
FIG. 4 shows a perspective view with partially cutaway components of a second embodiment of the connection construction of current feed and current distributor.
Figure 5:
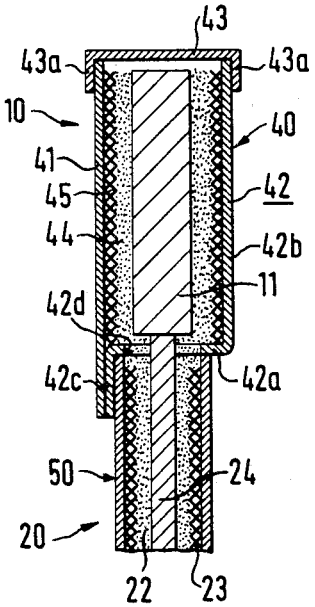
FIG. 5 shows a section through the arrangement of FIG. 4 along the section line V—V which corresponds to the section line V—V in FIG. 1.
Figure 6:
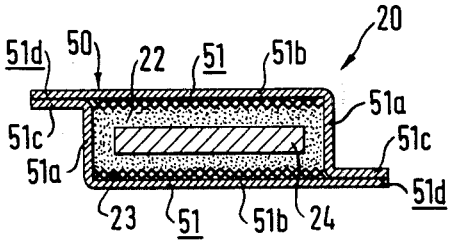
FIG. 6 shows a section through the current distributor of the arrangement according to FIG. 4 corresponding to the section line VI—VI.

FIGS. 4 to 6 relate to a further exemplary embodiment of the metal anode under discussion. A shown in FIG. 3, the horizontal copper rail of the current feed 10 is also designated with 11 whilst the bar of the current distributor 20 has the reference character 24.

The copper rail 11 of the current feed 10 is surrounded by a sleeve designated as a whole with 40 which is assembled from three profile members of valve metal. First of all, a flat profile member 41 is provided which forms the one vertical lateral surface of the sleeve. The other lateral surface of the sleeve 40 is manufactured by a profile member 42 which has an overall S-shape. This profile member is formed from a crosspiece **42*a* on whose ends on the one hand a longer limb 42*b* and on the other hand a shorter limb 42*c* are bent in opposite senses. The profile member 42 lies with its shorter limb 42*c* on the lower edge of the flat profile member 41. Both profile members are connected together at this position expediently by roll welding. The sleeve 40 is closed by a third U-shaped profile member 43 which embraces the upper edges of the profile members 41 and 42 with its two limbs 43*a* and is connected in this region expediently by welding to the profile members 41 and 42**.

The internal dimensions of the sleeve 40 are larger than the outer dimension of the rail 11 so that between these two components a core 44 can be cast in which in addition a contact structure 45 is embedded.

The bar 24 of the current distributor 20 connected to the rail 11 of the current feed 10 passes through the sleeve 40 via an aperture **42*d* in the bar 42*a* of the profile member 42. In the region of this aperture, the sleeve of the current distributor 20, designated in this case with 50, is closed in a gas and fluid tight manner. The sleeve 50 is formed from two profile members of valve metal designated with 51. The profile members are identical. Each profile member 51 is formed by a crosspiece 51*a* from whose ends at right angles limbs 51*b* and 51*c* of unequal length are bent in opposite senses. Both profiles 51 are turned towards one another in opposite senses, i.e. turned by 180° with reference to their axis, and assembled together in such manner that the short limb 51*c* of the one profile member 51 lies in the region of the free end of the long limb 51*b* of the other profile member 51, whereby flanges 51*d* result from the two narrow sides of the sleeve 50 which are mutually offset with reference to the center plane of the sleeve. On these flanges 51*d* of the sleeve 50 of the current distributor 20, the plate-like element 31 of the active part 30 can be connected without additional means. The remaining construction of the current distributor 20 corresponds to that shown in FIG. 3**.

We claim:

1. Electrode, in particular an anode made of coated valve metal for the electrolytic extraction of metals or metal oxides, comprising:

(a) a horizontally arranged current feed which comprises a rail made of a good electrical conductor, such as copper;

(b) at least one current distributor branching off from said current feed, the current distributor comprising a sleeve made of valve metal, a core disposed therein made of metal which is a good electrical conductor, the core being in electrically conductive connection with the sleeve, a bar disposed in the core, the bar being of a metal that is a good electrical conductor, such as copper, and a contact structure embedded in the core, the contact structure consisting of a valve metal and connected with the interior of said sleeve via a plurality of welded points;

(c) the bar of the current distributor being both mechanically and electrically conductively connected with the rail of the current feed;

(d) the rail of the current feed being surrounded by a sleeve which is connected with an upper edge of the sleeve of the current distributor that faces the current feed, so as to be both gas and liquid-proof; and (e) an active part which is connected both mechanically as well as electrically conductively with the sleeve of the current distributor.

2. Electrode according to claim 1 wherein said bar passes through the core of the current distributor substantially over its entire length.

3. Electrode according to claim 1 wherein said bar has an outer surface structure such that a form-locking toothed region is present between the bar and the core.

4. Electrode according to claim 3 wherein the outer surface structure is formed by grooves, bores, projections or the like.

5. Electrode according to claim 1 wherein the current feed sleeve is produced by casting a corrosion-resistant material about said rail.

6. Electrode according to claim 1 wherein the current feed sleeve is formed by assembled profile members of valve metal.

7. Electrode according to claim 6 wherein the current feed sleeve and the current distributor sleeve are both connected to the core metal.

8. Electrode according to claim 6 wherein a contact structure is embedded in the core of the current feed.

* * * * *